US011459628B2

(12) United States Patent
Rehrl et al.

(10) Patent No.: US 11,459,628 B2
(45) Date of Patent: Oct. 4, 2022

(54) METHOD FOR PRODUCING METALLIC COMPONENTS HAVING ADAPTED COMPONENT PROPERTIES

(71) Applicant: voestalpine Stahl GmbH, Linz (AT)

(72) Inventors: Johannes Rehrl, Linz (AT); Thomas Kurz, Linz (AT); Andreas Pichler, Vocklabruck (AT)

(73) Assignee: voestalpine Stahl GmbH, Linz (AT)

( * ) Notice: Subject to any disclaimer, the term of this patent is extended or adjusted under 35 U.S.C. 154(b) by 192 days.

(21) Appl. No.: 16/956,642

(22) PCT Filed: Dec. 21, 2018

(86) PCT No.: PCT/EP2018/086685
§ 371 (c)(1),
(2) Date: Dec. 29, 2020

(87) PCT Pub. No.: WO2019/122372
PCT Pub. Date: Jun. 27, 2019

(65) Prior Publication Data

US 2021/0164066 A1 Jun. 3, 2021

(30) Foreign Application Priority Data

Dec. 22, 2017 (DE) ..... 10 2017 131 253.6

(51) Int. Cl.
*C21D 1/26* (2006.01)
*C22C 38/00* (2006.01)
(Continued)

(52) U.S. Cl.
CPC ..... *C21D 1/26* (2013.01); *C21D 1/185* (2013.01); *C21D 1/673* (2013.01); *C21D 8/0205* (2013.01);
(Continued)

(58) Field of Classification Search
None
See application file for complete search history.

(56) References Cited

U.S. PATENT DOCUMENTS 8,114,227 B2 2/2012 Corquillet et al.
9,863,026 B2 1/2018 Yokoi et al.
(Continued)

FOREIGN PATENT DOCUMENTS

DE 102007062597 A1 6/2009
DE 102009030489 A1 12/2010
(Continued)

OTHER PUBLICATIONS

International Preliminary Examination Report for PCT/EP2018/086685, dated Jul. 2, 2020.
(Continued)

*Primary Examiner* — Anthony M Liang
(74) *Attorney, Agent, or Firm* — Maxwell J. Petersen; FisherBroyles, LLP

(57) ABSTRACT

The invention relates to a method for producing a sheet steel component by means of a press hardening or form hardening process, the sheet steel component being produced by virtue of the fact that a sheet bar composed of at least one region made of a highly hardenable carbon/manganese/boron steel and at least one dual-phase steel is cold-formed, then heated, and then quenched in a cooling press or a sheet bar composed of at least one region made of a highly hardenable carbon/manganese/boron steel and at least one region made of a dual-phase steel is heated to a temperature above the austenitization temperature of the highly hardenable steel material and is then formed into the sheet steel component in a single stroke or in a plurality of strokes in a forming and cooling press, wherein as a softer material and as a partner for the highly hardenable carbon/manganese/boron steel, a dual-phase steel is used, whose Ac3 value is increased until
(Continued)

Figure 1:
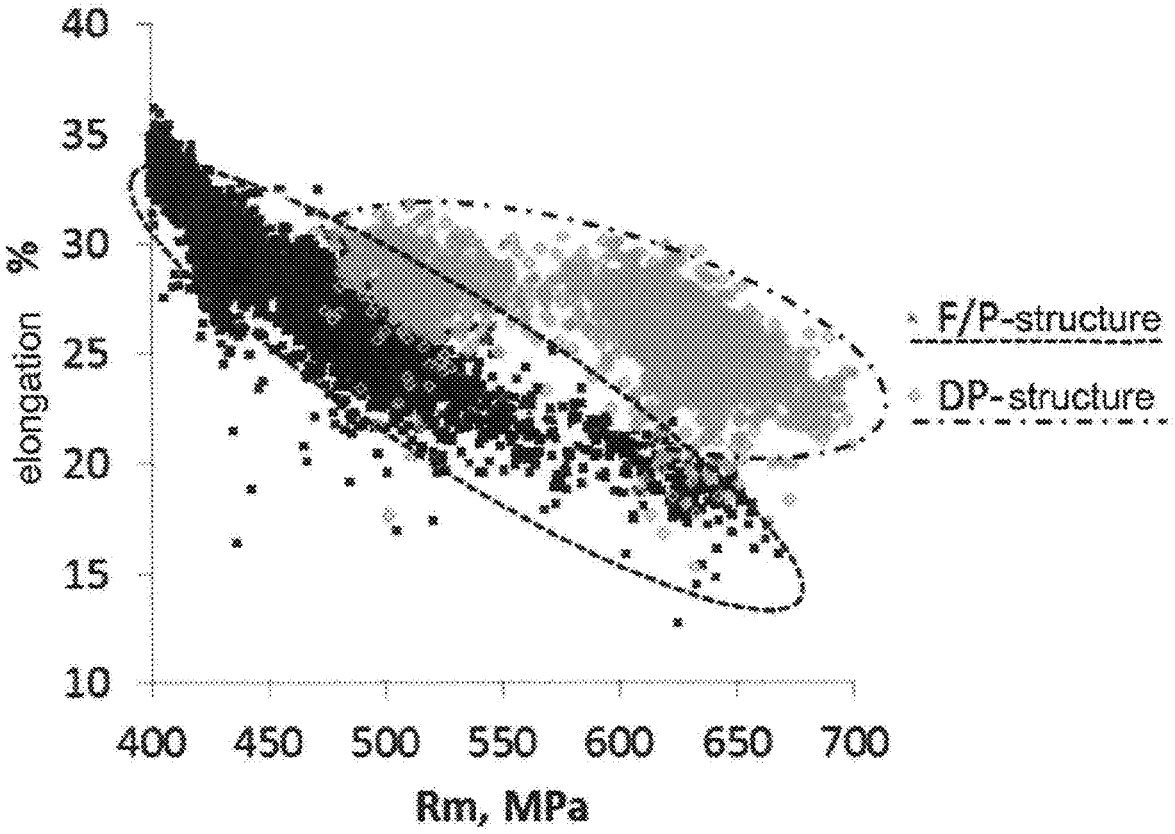

at the required annealing temperatures, with the austenitization of the carbon/manganese/boron steel, only a partial austenitization of the dual-phase steel takes place so that when loaded into the cooling press, the dual-phase steel has a ferritic matrix, and in addition to this, austenite is present.

17 Claims, 11 Drawing Sheets

(51) Int. Cl.

| | |
|---|---|
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/34*** | (2006.01) |
| ***C22C 38/38*** | (2006.01) |
| ***C21D 1/18*** | (2006.01) |
| ***C21D 8/02*** | (2006.01) |
| ***C21D 9/00*** | (2006.01) |
| ***C21D 9/50*** | (2006.01) |
| ***C21D 1/673*** | (2006.01) |

(52) U.S. Cl.

CPC ..... *C21D 9/0068* (2013.01); *C21D 9/50* (2013.01); *C22C 38/002* (2013.01); *C22C 38/04* (2013.01); *C22C 38/06* (2013.01); *C22C 38/26* (2013.01); *C22C 38/28* (2013.01); *C22C 38/34* (2013.01); *C22C 38/38* (2013.01); *C21D 2201/00* (2013.01); *C21D 2211/001* (2013.01); *C21D 2211/005* (2013.01); *C21D 2211/008* (2013.01)

(56) References Cited

U.S. PATENT DOCUMENTS

| | | | |
|---|---|---|---|
| 2008/0308194 | A1 | 12/2008 | Corquillet et al. |
| 2012/0273092 | A1 | 11/2012 | Ratte |
| 2014/0020795 | A1 | 1/2014 | Schwinghamer et al. |
| 2015/0041024 | A1 | 2/2015 | Schulz et al. |
| 2021/0017617 | A1 | 1/2021 | Pichler et al. |

FOREIGN PATENT DOCUMENTS

| | | | |
|---|---|---|---|
| DE | 102010055148 | A1 | 6/2012 |
| DE | 102012002079 | A1 | 8/2013 |
| DE | 10214017274 | A1 | 5/2016 |
| EP | 000001929053 | B1 | 6/2008 |
| EP | 1929053 | B1 | 6/2008 |
| EP | 3231885 | A1 | 10/2017 |
| EP | 3728657 | B1 | 11/2021 |
| WO | 2011054575 | A1 | 5/2011 |
| WO | 2014019673 | | 2/2014 |

OTHER PUBLICATIONS

Yi H. L. et al., "Dual Phase Hot-Press Forming Alloy," Materials Science and Engineering: A, vol. 527, No. 18, Jan. 1, 2010, pp. 4870-4874.

International Search Report for PCT/EP2018/086685, dated Jun. 4, 2019.

Hein Philipp et al., Status and Innovation Trends in Hot Stamping of USIBOR 1500P Steel Research Internatio, Verlag Stahleisen GmbH, Dusseldorf, DE, vol. 79, No. 2. Feb. 1, 2008, pp. 85-91.

0.06C 1.2Mn: structure at 750°C, KR=WQ 0.06C 1.2Mn: structure at 750°C, KR=70K/s 0.1C 1.5Mn 1.0Al 0.06C 1.5Mn 1.0Al 0.08C 1.7Mn 1.0Al 0.08C 1.2Mn 1.0Al 0.08C 1.5Mn 1.4Al 0.08C 1.5Mn 0.5Al

| alloy | C, wt.% | Si, wt.% | Mn, wt.% | Al, wt.% | Cr, wt.% | Nb+Ti, wt.% | $A_{r1}$, °C | $A_{c3}$, °C | according to the invention |
|---|---|---|---|---|---|---|---|---|---|
| alloy A | 0,06 | 0,2 | 1,5 | 1,0 | 0,5 | 0,03 | 719 | 1000 | yes |
| alloy B | 0,08 | 0,2 | 1,5 | 1,0 | 0,5 | 0,03 | 718 | 981 | yes |
| alloy C | 0,10 | 0,2 | 1,5 | 1,0 | 0,5 | 0,03 | 718 | 968 | yes |
| alloy D | 0,08 | 0,2 | 1,2 | 1,0 | 0,5 | 0,03 | 729 | 1001 | no |
| alloy E | 0,08 | 0,2 | 1,7 | 1,0 | 0,5 | 0,03 | 710 | 975 | no |
| alloy F | 0,08 | 0,2 | 1,5 | 0,5 | 0,5 | 0,03 | 704 | 904 | no |
| alloy G | 0,08 | 0,2 | 1,5 | 1,4 | 0,5 | 0,03 | 730 | 1074 | yes |
| alloy H | 0,30 | 0,3 | 2,2 | <0.05 | <0.05 | <0.05 | 669 | 767 | no |
| alloy I | 0,26 | 0,3 | 1,8 | 0,3 | <0.05 | <0.05 | 658 | 818 | no |
| alloy J | 0,05 | 0,6 | 0,7 | 0,7 | 0,35 | <0.05 | 739 | 1028 | yes |
| alloy K | 0,08 | 0,8 | 1,3 | 0,9 | 0,5 | <0.05 | 734 | 1020 | yes |
| alloy L | 0,10 | 1,3 | 1,8 | 1,3 | 0,7 | <0.05 | 741 | 1067 | yes |
| alloy M | 0,11 | 1,8 | 1,9 | 1,1 | 0,6 | <0.05 | 738 | 1063 | yes |

Fig. 11

METHOD FOR PRODUCING METALLIC COMPONENTS HAVING ADAPTED COMPONENT PROPERTIES

The invention relates to a method for producing metallic components with adapted component properties according to the preamble of claim 1. The invention particularly relates to a method for producing steel sheets and steel components made from them; the sheets are composed of sheet pieces with different properties and are in particular welded together.

In the prior art, it is known to produce welded sheet bars out of steel sheets of different thicknesses and/or steel sheets of different compositions, which are then available for a further processing such as a shaping or heat treatment. Such sheets are referred to as tailored welded blanks (TWB).

What this means is that by means of the different compositions, it is possible to design the properties of a finished formed component differently in different zones.

Such tailored welded blanks play an important role particularly in the production of motor vehicle bodies.

In the past, there has been a need, for energy-saving reasons, to design lighter-weight vehicles and in particular, lighter-weight vehicle bodies. It has also been necessary, however, to make vehicle bodies more stable and in particular, to effectively protect the passenger compartment in the event of an accident. Correspondingly, in the past, this has been distilled down to the fact that the body of vehicles was at least partially constructed of very highly hardenable steels (CMnB steels). These highly hardenable steels are produced in sheet form, then formed, and then the formed components are heated to very high temperatures until they are completely austenitized, and then are transferred to a cooling press and in this cooling press, are cooled through contact on all sides with cold tool jaws or forms at a speed that is above the critical hardening speed so that the completely austenitized component is at least predominantly in the martensitic phase, which enables achievement of hardnesses of up to more than 1500 MPa. This method, in which first shaping, then hardening, and then cooling through placement in the form are carried out, is also referred to as the indirect method or form hardening.

In so-called press hardening, the sheet bar composed of the highly hardenable steel is heated to a temperature above the austenitization temperature and is austenitized as completely as possible. Then this sheet bar in the austenitized state is transferred to a forming tool and with one or more press strokes, is both formed and hardened by the significant thermal outflow from the sheet bar into the forming tool. This method is also referred to as the direct method.

Through these two methods, it was and is essentially possible to design a vehicle body with very hard parts and to produce the rest of the body in a correspondingly graduated fashion out of parts with different ductilities and hardnesses.

A modern vehicle body thus consists of a number of load-conveying high-strength components and also soft, deformable elements for energy absorption.

By means of tailored welded blanks (TWB), it is possible to integrate both properties, i.e. the load-conveying and the deforming capacity into a single component, which enables improvements in energy absorption in the event of a crash and an even further improved passenger protection in motor vehicles. These tailored welded blanks therefore consist of hardenable regions composed of the above-mentioned CMnB steels and weld-attached regions composed of a softer partner material.

Tailored welded blanks of this kind can also be processed using both of the above-mentioned hardening methods. A high-strength martensitic hardening structure is thus produced in the hardenable region during the press hardening process or the form hardening process, i.e. during the direct or indirect process. The softer partner material likewise takes part in the press hardening process, but because of the different alloy level, significantly lower strength values are enabled, with higher elongation values, thus enabling a large amount of energy absorption.

Naturally, monolithic, soft and ductile components can also be produced, which are subsequently joined to the hard components in the body by means of a welding process.

Consequently, steels that have a structure composed of ferrite and perlite are usually used as the soft partner material.

Such tailored welded blanks are already well-known from the prior art. In particular, there is a multitude of materials that are already well-known as soft partner materials.

The object of the invention is to create a method in which in a simple and inexpensive way, for example tailor welded blanks are produced in which the softer partner achieves stable mechanical characteristic values independent of the cooling situation.

The object is attained with a method having the features of claim 1.

Another object of the invention is to create a material that is suitable for use as a soft partner material particularly in tailor welded blanks and that ensures stable mechanical characteristic values independent of the cooling situation and independent of the cooling sequence.

This object is attained with a material having the features of claim 10.

Advantageous modifications are disclosed in the claims that are dependent thereon.

According to the invention, the softer partner material is embodied in a tailored welded blank made of a steel with a dual-phase structure (DP steel). The dual-phase structure according to the invention consists of a ferritic matrix with embedded martensite inclusions. Through the enormous strengthening capacity, this enables the achievement—with the same strength—of a significantly better formability in the sense of the ultimate elongation and thus higher energy absorption than the ferritic-perlitic structure that is known in the prior art. The steels with a dual-phase structure according to the invention are thus very well-suited for use as the soft partner material.

Known dual-phase steels are disclosed, for example, by EP 2 896 715 B1, which describes a dual-phase steel with titanium precipitation hardening.

EP 2 290 111 B1 discloses a dual-phase steel with a ferritic structure for automobiles.

JP 2009/132981 A discloses a ferritic cold-rolled steel with a high degree of formability.

WO2017/144419 A1 discloses a press hardened steel with a dual-phase structure.

US 2010/0221572 A1 discloses a press hardened steel with a structure composed of ferrite, bainite, and martensite.

DE 10 2014 11 21 26 A1 discloses a microalloyed steel with a given cooling rate number.

EP 2 896 715 B1 discloses a dual-phase steel with titanium precipitation hardening.

According to the invention, it has been discovered that in order to achieve a ferritic-martensitic dual-phase structure in the press hardening, the formation of perlite and bainite must be delayed in such a way that these structural phases do not occur at the usual cooling rates.

According to the invention, in order to delay the formation of perlite and bainite, manganese, chromium, boron, and molybdenum are added to the alloy. It has turned out, however, that this also delays the formation of ferrite after the fully austenitic annealing in the furnace, which is critical with short transfer times between the furnace and press, high loading temperatures, and high cooling rates in the press. As a result, a structure can form, which consists of a tempered martensitic matrix with little ferrite, which while achieving high strengths, only has low elongations. Only at lower cooling rates in the press do stable mechanical characteristic values occur, regardless of the loading temperature in the press.

According to the invention, in order to ensure the presence of a sufficient quantity of ferrite and thus a ferritic matrix in the structure, the material is annealed in the furnace in such a way that in addition to austenite, ferrite is also present. Thus according to the invention, intercritical annealing occurs in the furnace. Intercritical annealing means that the material is annealed between its Ac1 and Ac3 temperatures.

The ferrite quantity required to constitute a ferritic matrix is achieved during the cooling between the furnace and press, not only by the ferrite nucleation with subsequent ferrite growth, but also by the steady growth of the ferrite that is present due to the intercritical annealing. According to the invention, therefore, the Ac3 temperature for the soft partner material must be kept high in order for an intercritical annealing to even be possible. According to the invention, the Ac3 value is increased by means of aluminum. According to the invention, therefore, the dual-phase steel is embodied with an elevated aluminum content. Consequently, a fully austenitic annealed state is impeded as a function of the alloy.

In this case, based on the CMnB partner steel, the annealing temperature is set to >800° C. so that this annealing value must be assumed as a given for the intercritical annealing.

Usually, the Ac3 temperature of CMnB steels is approximately 840° C.

The concept of the invention thus basically consists of a C—Si—Mn—Cr—Al—Nb/Ti alloy concept.

The carbon contained in it is used to adjust the strength level; a higher carbon content reduces the Ac3 value, increases the strength, and likewise increases the yield strength. But the elongation decreases, the formation of ferrite, perlite, and bainite is delayed, and the martensite quantity in the structure increases.

The purpose of the manganese is to adjust the strength level. More manganese decreases the Ac3 value; it also increases the strength and the yield strength. With a higher manganese content, the elongation decreases, the formation of ferrite, perlite, and bainite is delayed, and the martensite quantity in the structure increases.

As already explained above, with the concept according to the invention, aluminum is used because more aluminum increases the Ac3 value, which reduces the sensitivity to the loading temperature in the press. In addition, improvements in the elongation are achieved, the martensite quantity in the structure decreases, and the ferrite quantity increases.

In the alloy according to the invention, silicon increases the strength level, increases the Ac3 value, and delays the formation of perlite and bainite.

Table 1 lists typical values of Ae1 temperatures and Ae3 temperatures for DP steels according to the invention as well as for alloys not according to the invention. These calculated values essentially correspond to the Ac1 temperatures and Ac3 temperatures.

In the exemplary embodiments not according to the invention, either an excessively low Ae1 temperature or Ae3 temperature is achieved by the respectively selected alloy composition and/or the desired mechanical characteristic values are not achieved (for example due to excessively low silicon percentages).

The chromium primarily delays the formation of perlite and bainite and ensures the formation of martensite so that chromium has a significant influence on ensuring the dual-phase nature.

Niobium and titanium force the formation of ferrite and have a grain-refining influence.

According to the invention, it is thus sufficient, as the softer partner material, to provide a material in the form of a dual-phase steel, which supplies stable mechanical characteristic values independently of the cooling situation and thus yields reliably achieved and embodied tailored welded blanks in the press hardening or form hardening process.

Figure 2:
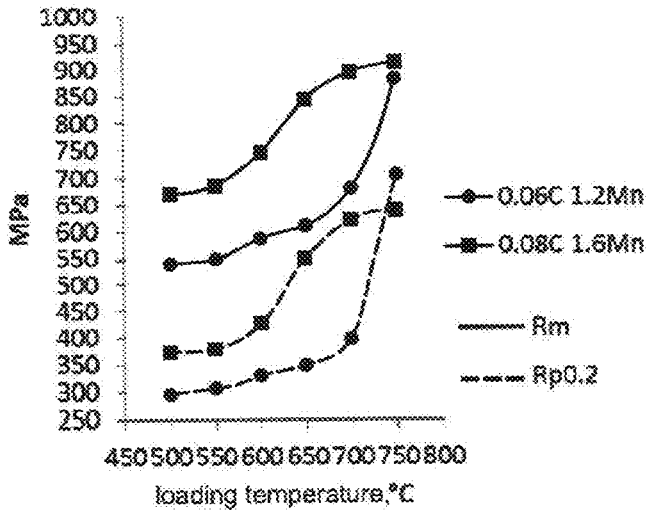
Figure 2:
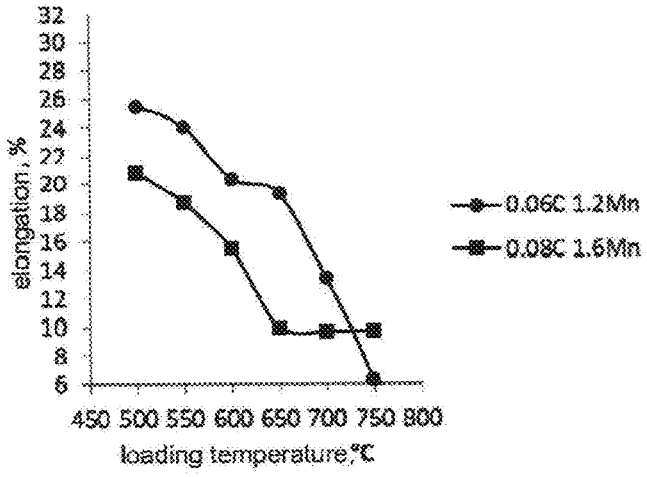
Figure 2:
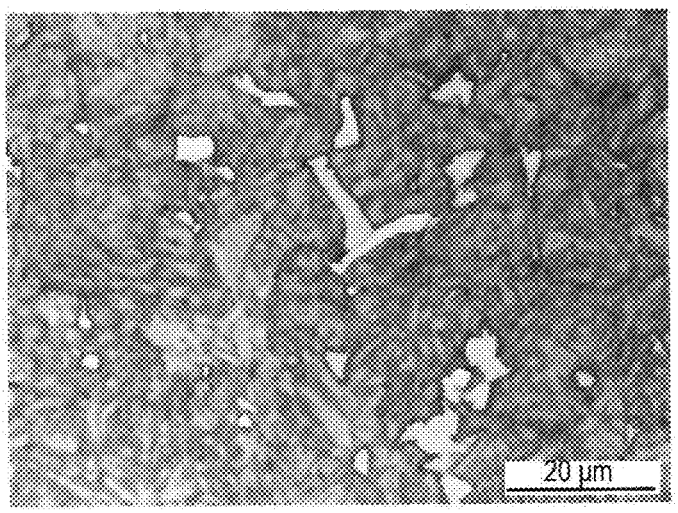
Figure 3:
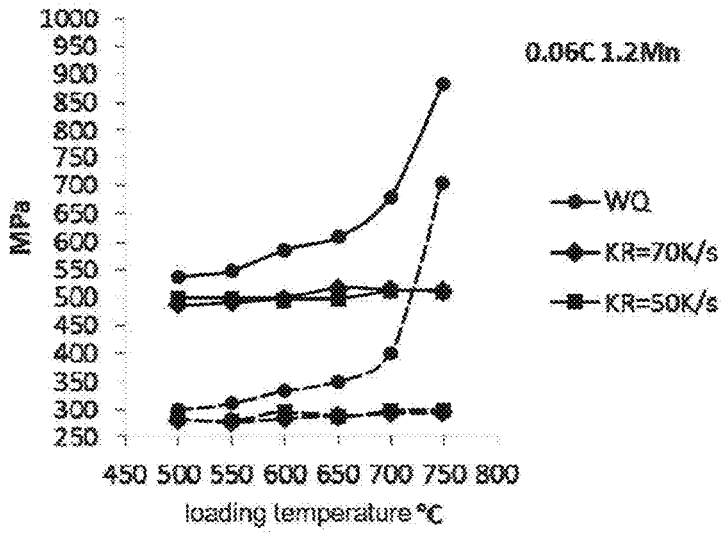
Figure 3:
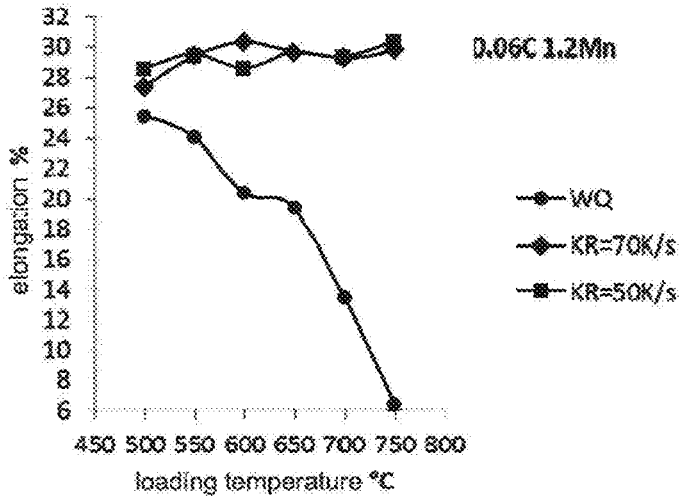
Figure 3:
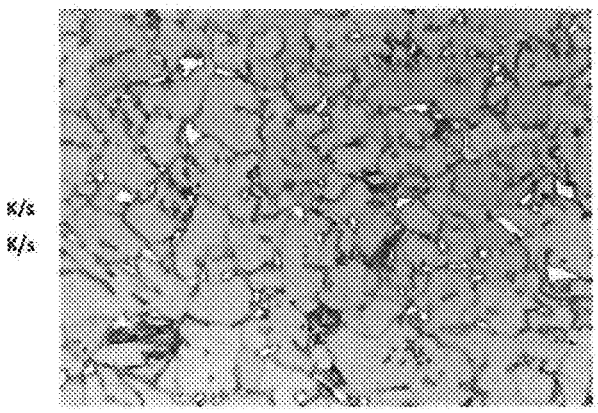
Figure 4:
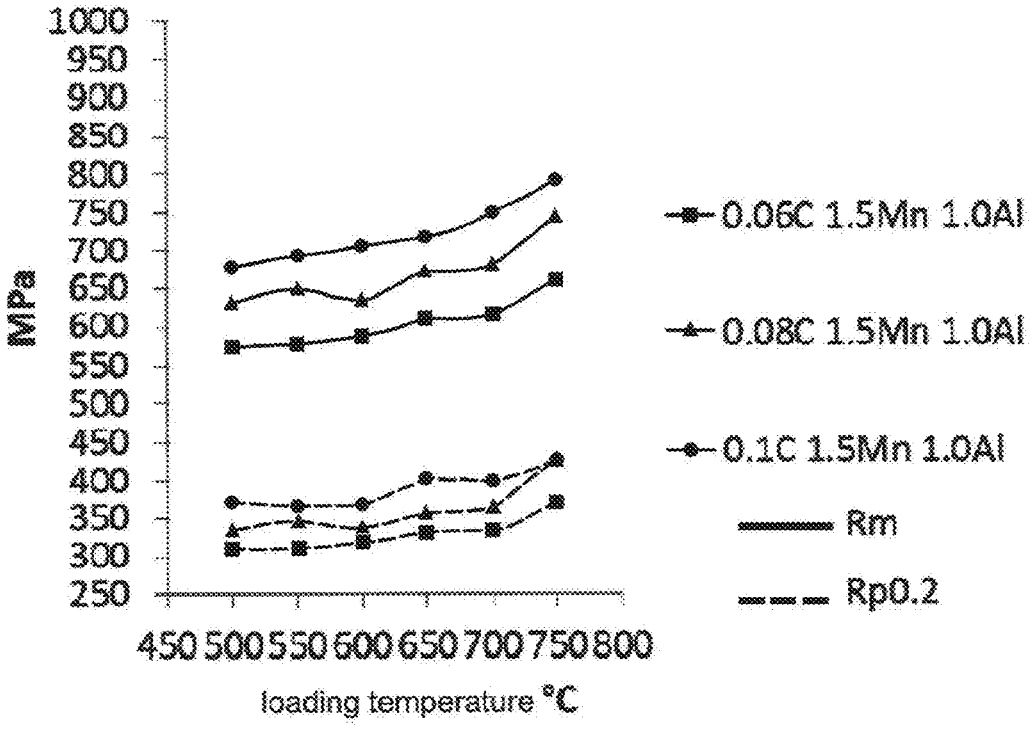
Figure 4:
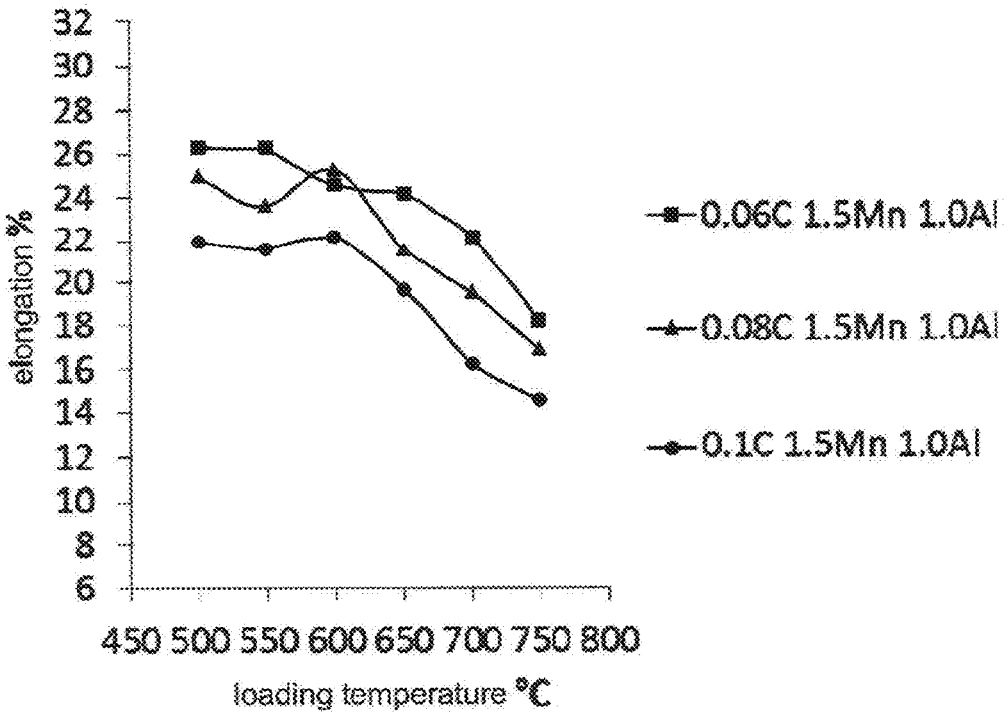
Figure 5:
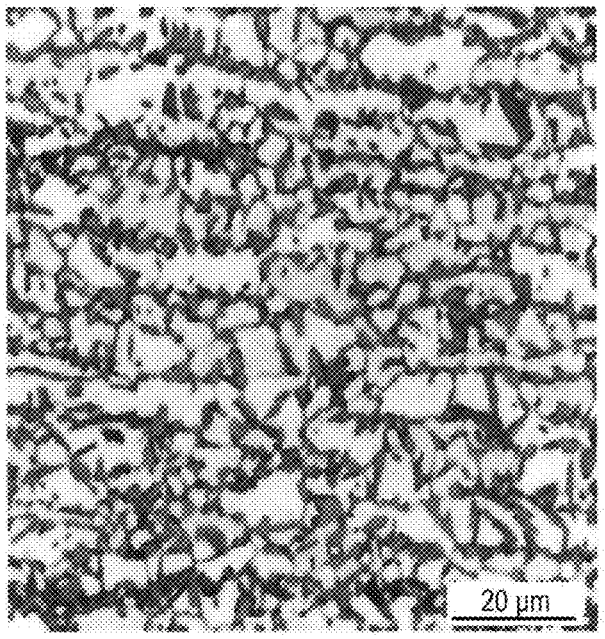
Figure 5:
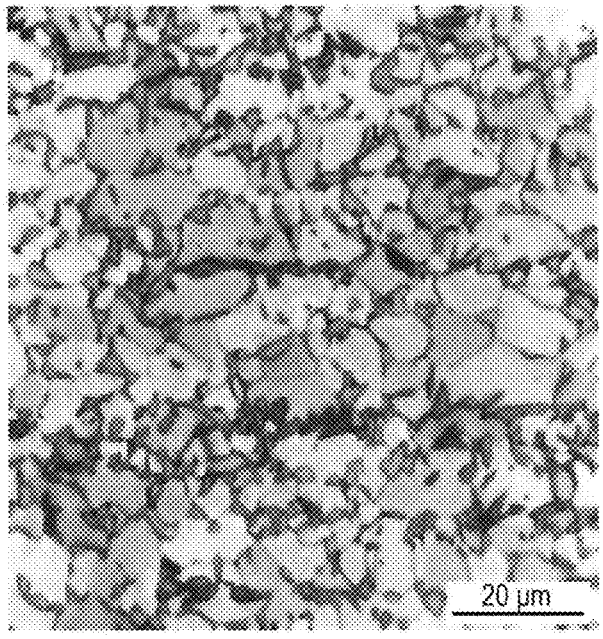
Figure 6:
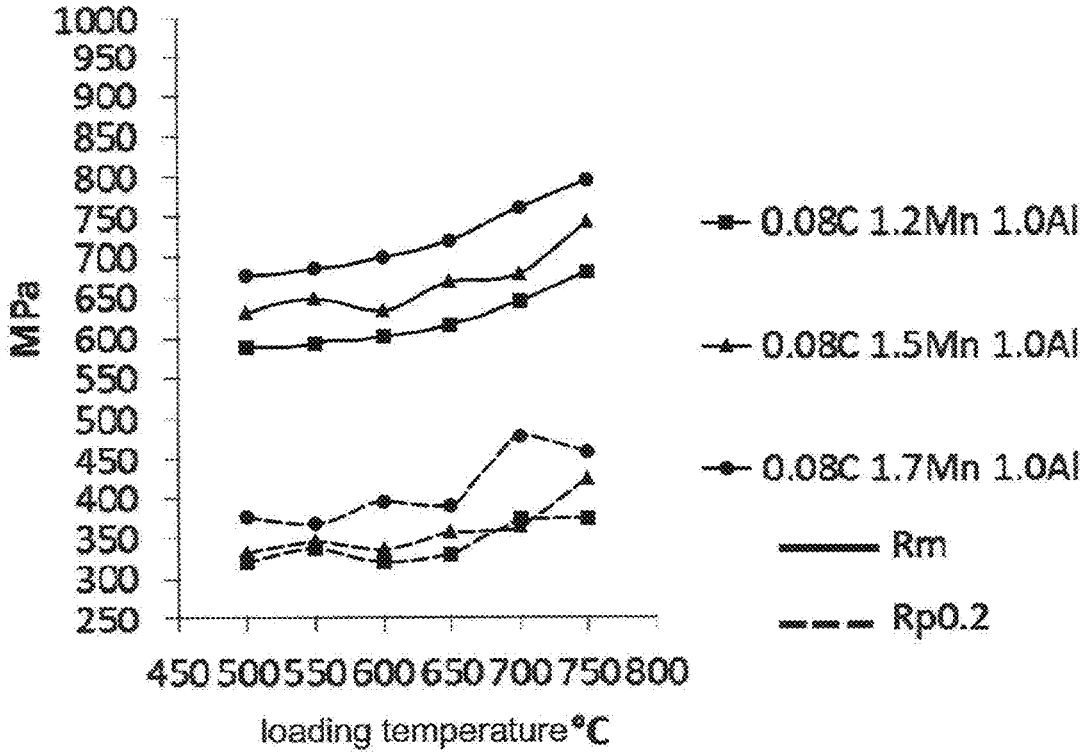
Figure 6:
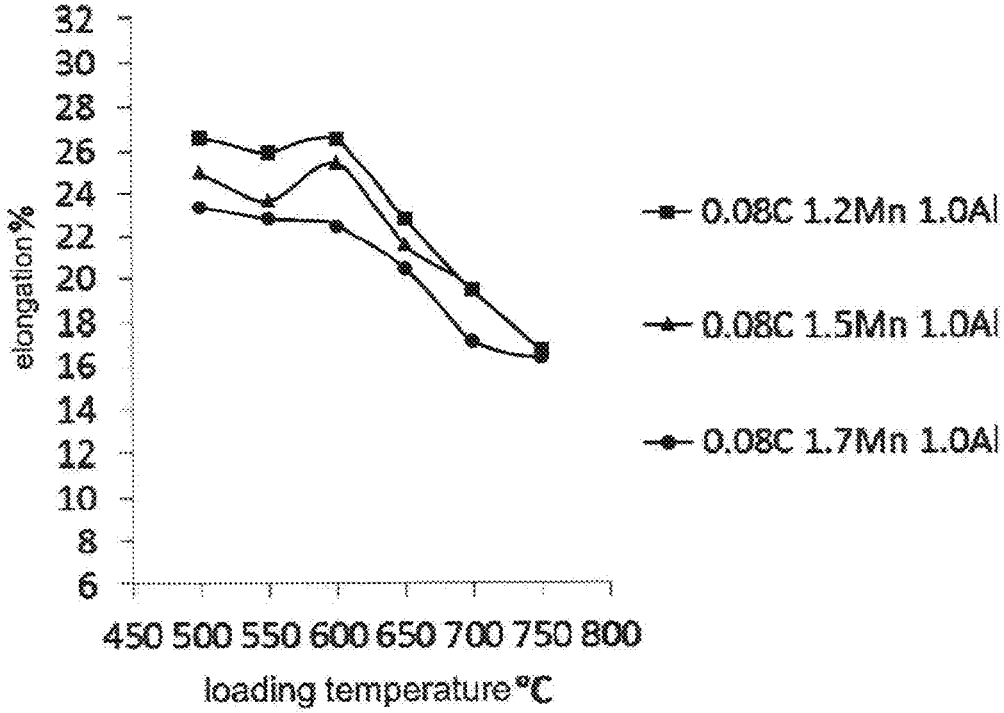
Figure 7:
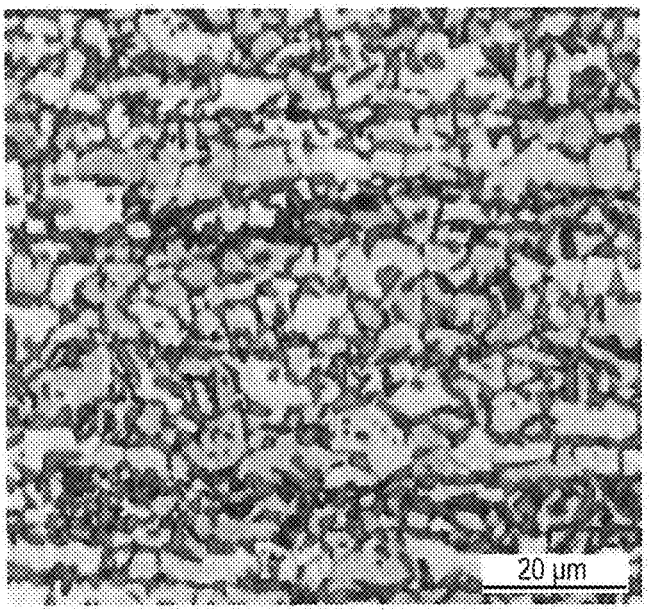
Figure 7:
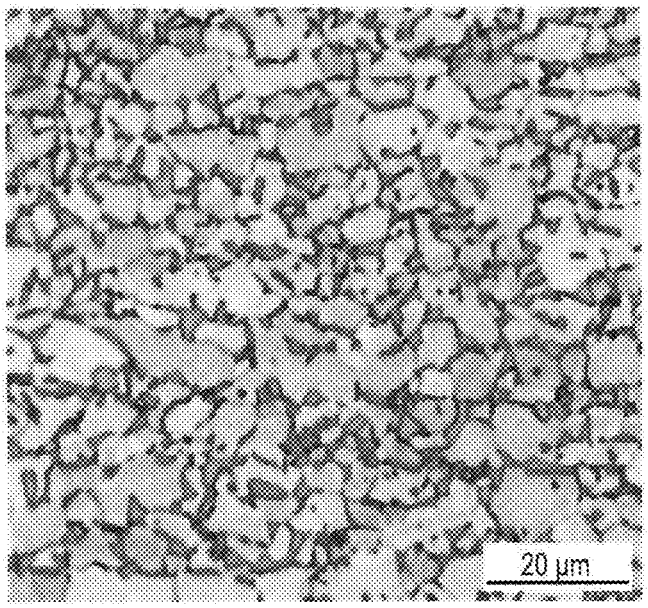
Figure 8:
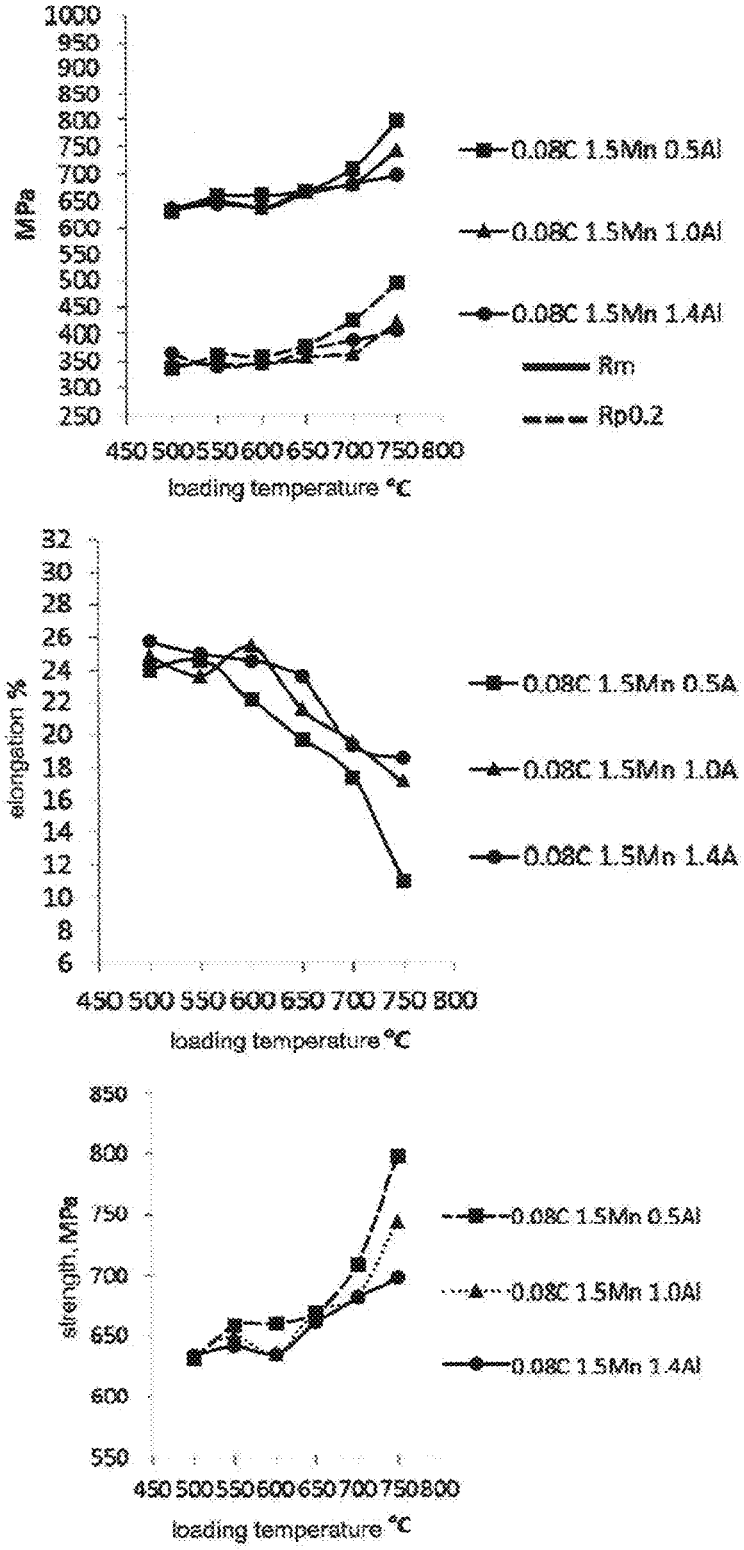
Figure 9:
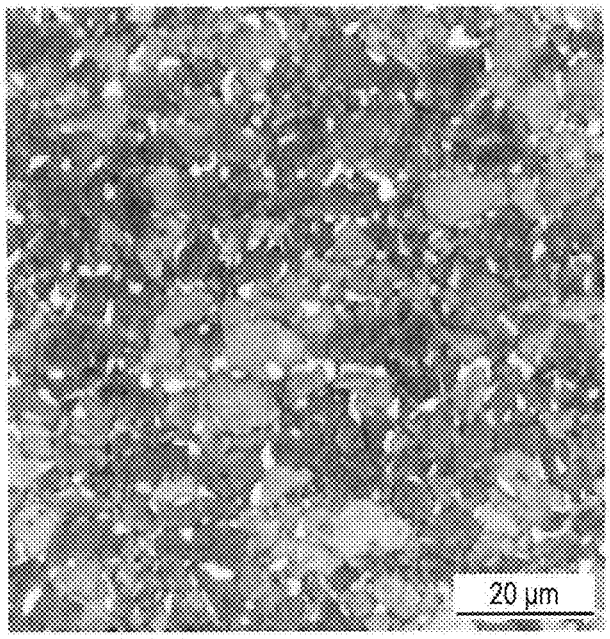
Figure 9:
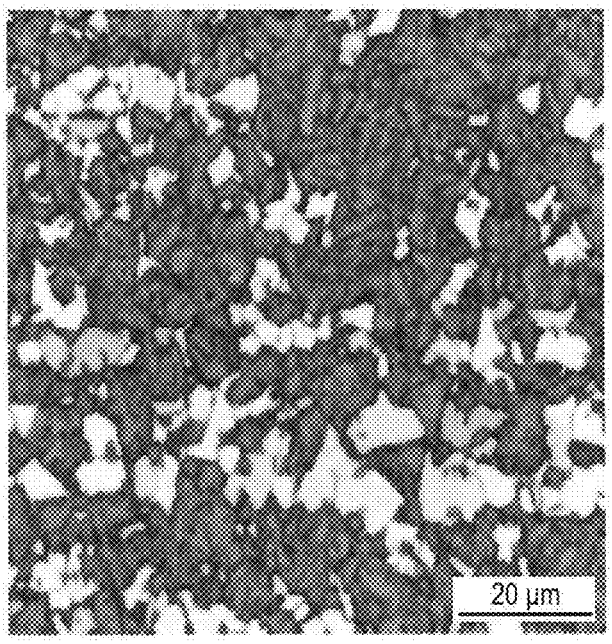
Figure 10:
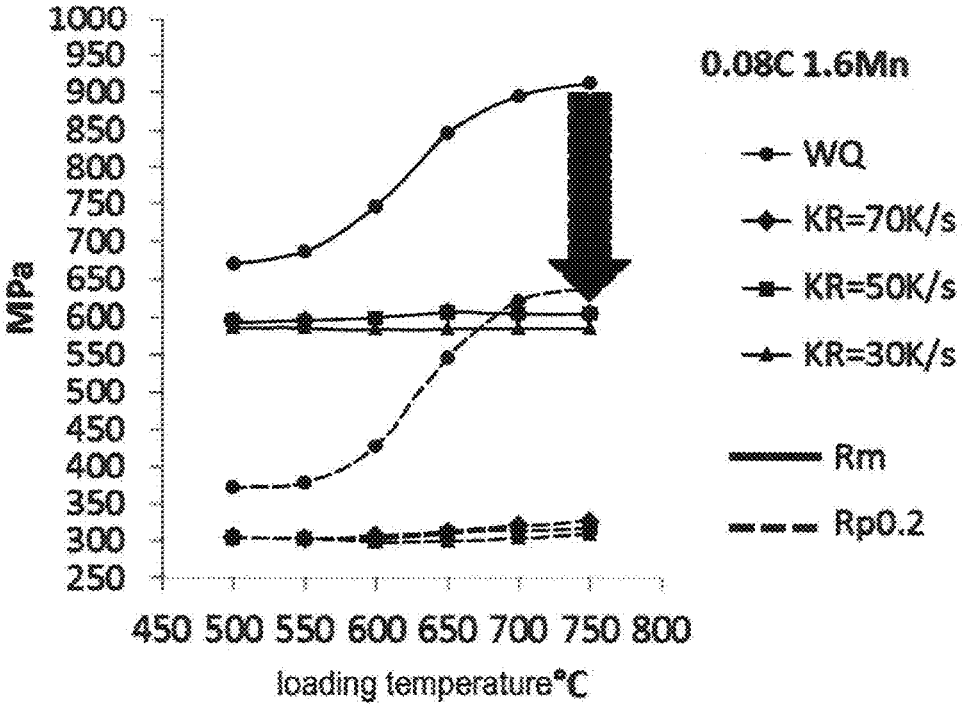
Figure 10:
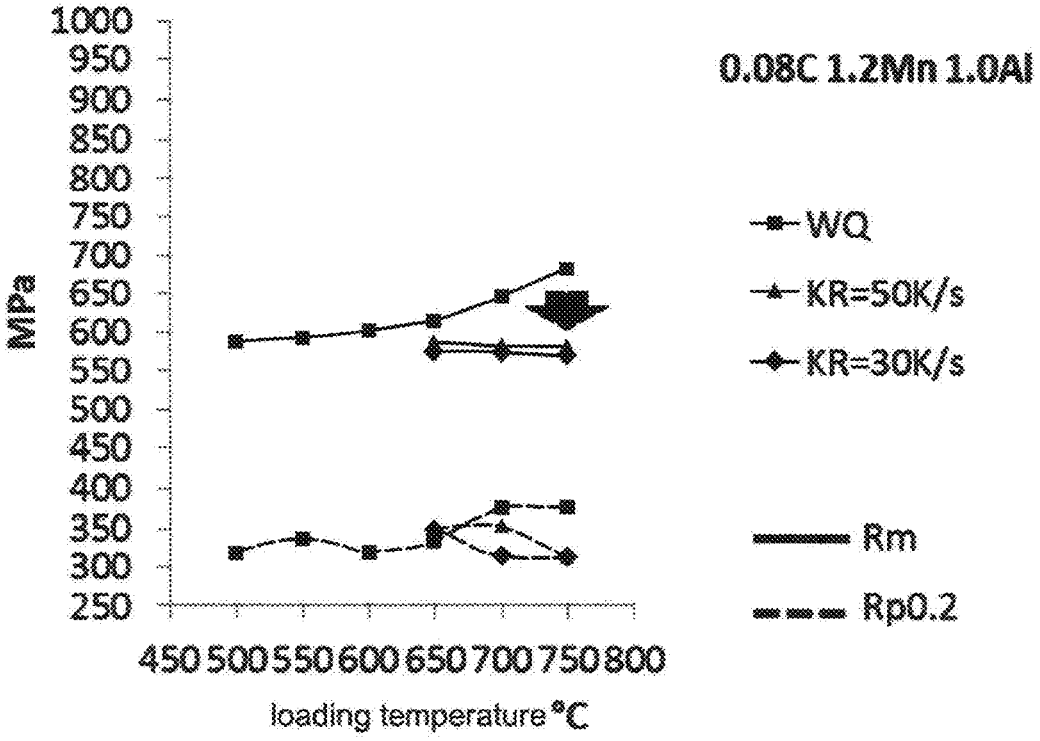

The invention will be explained by way of example based on the drawings. In the drawings:

FIG. 1: shows the elongation and strength of dual-phase structures and ferritic-perlitic structures according to the prior art;

FIG. 2: shows the behavior of fully austenitically annealed dual-phase steels with high cooling rates in the press, first showing the strength as a function of the loading temperature and then showing the elongation as a function of the loading temperature as well as the achievable structure;

FIG. 3: shows the behavior of fully austenitically annealed dual-phase steels at high and low cooling rates in the press;

FIG. 4: shows the influence of carbon on the mechanical characteristic values as a function of the loading temperature;

FIG. 5: shows structure images of dual-phase steels with different carbon contents;

FIG. 6: shows the influence of manganese on the mechanical characteristic values;

FIG. 7: shows the structure images with different manganese contents;

FIG. 8: shows the influence of aluminum on the mechanical characteristic values;

FIG. 9: shows the structure images with different aluminum contents;

FIG. 10: shows the influence of the intercritically annealed aluminum-alloyed dual-phase steel concept according to the invention in comparison to fully austenitically annealed carbon/manganese alloys.

FIG. 11: corresponds to Table 1 and describes specific alloys that are within and not within the scope of the present invention.

The method according to the invention provides producing a tailored welded blank (TWB) by combining at least one usually flat sheet part, which is composed of a highly hardenable steel material such as a boron/manganese steel and in particular a steel from the family of 22MnB5 or 20MnB8 and steels of the like, with at least one usually flat sheet part composed of a dual-phase steel.

Such a combined tailored welded blank can then be sufficiently heated in the direct or indirect method and then formed or else formed and then heated and quenched.

According to the invention, a dual-phase steel with a relatively high aluminum content is used. According to the invention, it has been discovered that aluminum decreases the sensitivity of the mechanical characteristic values to the loading temperature and sharply decreases their sensitivity to the cooling rate in the press.

With high cooling rates in the press, simple carbon/manganese alloys, which are fully austenitically annealed in the furnace, are highly dependent on the loading temperature.

The composition of the dual-phase steel according to the invention is as follows, with all percentages being indicated in mass %:

C 0.02-0.12%, preferably 0.04-0.10%

Si 0.05-2.0%, preferably 0.20-1.60%, and especially preferably, 0.50-1.50%

Mn 0.5-2.0%, preferably 0.6-1.50%

Cr 0.3-1.0%, preferably 0.45-0.80%

Al 0.4-1.5%, preferably 0.50-1.30%, and especially preferably, 0.60-1.20%

Nb <0.20%, preferably 0.01-0.10%

Ti <0.20%, preferably 0.01-0.10% Residual quantities of iron and inevitable smelting-related impurities.

With a dwell time in the furnace of up to 600 seconds, in particular up to 300 seconds, at the annealing temperatures of about 840° C. that are typical for the austenitization of the highly hardenable partner material, only a partial austenitization is achieved with regard to the dual-phase steel.

The degree of austenitization that occurs in the dual-phase steel is between 50 and 90% by volume, with the desired structure being a fine dual-phase steel with ferritic matrix and 5 to 20% by volume martensite and possibly some bainite.

The desired structure occurs if the following cooling sequence is maintained and thus if—during the manipulation of the component or sheet bar in the cooling press, i.e. during handling—a cooling rate of 5 to 500 Kelvin/sec is maintained and the loading temperature in the cooling press is 400 to 850° C., preferably 450 to 750° C., the loading temperature being adjusted to 700 to 800° C. in the cooling press during the form hardening process (indirect method).

In the press hardening process (direct method), the loading temperature is set to 400 to 650° C., preferably 440 to 600° C., and especially preferably, 450 to 520° C.

The special effect—primarily in the direct process, i.e. press hardening—that is achieved with a loading temperature of 450 to 520° C. is that this permits the structure to be established in an optimal way, yielding a system that is particularly robust with regard to cooling rates.

Furthermore with TWB sheet bars or components, there is a need on the one hand for the loading temperature based on the desired structure for the dual-phase part to not be excessively high and there is a need on the other hand for the loading temperature to not be excessively low since otherwise, the carbon/manganese/boron steel falls below the Ms temperature.

The cooling rate in the press should be 10 Kelvin/sec.

To achieve this, an air cooling (for example a cooling rate of 5 Kelvin/sec to 70 Kelvin/sec) or for example a plate cooling can be carried out (cooling rates of more than 80 Kelvin/sec are easily achievable).

The resulting mechanical properties according to the invention are as follows:

$R_{p0.2}$ 250 to 500 MPa $R_m$ 400 to 900 MPa

A≥10%.

FIG. 1 shows the differences with regard to the ratio of the elongation to the tensile strength $R_m$ with a ferritic-perlitic structure (gray) and a dual-phase structure (black). It is clear that a dual-phase structure is very well-suited for the purposes according to the invention.

The following problems, however, occur when adjusting the alloy according to the prior art:

With high cooling rates in the cooling press, fully austenitically annealed dual-phase steels have unfavorable properties. FIG. 2 shows that with two different steels, namely one being a steel with 0.06% carbon and 1.2% manganese and another being a dual-phase steel with 0.08% carbon and 1.6% manganese, depending on the loading temperature, there is a very large spread with regard to the tensile strength $R_m$ of approx. 550 MPa to 880 MPa that is achieved in the steel with less carbon and less manganese.

Even in the steel with the higher carbon content and higher manganese content, the achievable tensile strength is from about 660 MPa to about 920 MPa. But this also means that with the variable loading temperatures and with the fluctuations in the loading temperature that are customary in the process, it is difficult to achieve reproducible strength values within the desired tolerances with the known dual-phase steels. The same is the case with the $R_{p0.2}$ value, which fluctuates in a comparable way so that keeping these two important characteristic values within a manageable range is far from possible.

When it comes to the elongation, the same is true of the two steels, i.e. the elongation values fluctuate so significantly as a function of the loading temperature that conventional dual-phase steels are absolutely not an option for use as partners for a highly hardenable steel with the known process windows and the known loading temperature fluctuations. The structure of the lower-alloyed steel from the two graphic depictions is shown at a 750° loading temperature and a cooling rate that was achieved by means of water cooling.

FIG. 3 also shows that the depicted characteristic values, particularly when cooling with water, are highly dependent on the loading temperature and the cooling rate in the press, with the structure also differing significantly from the structure according to FIG. 2 since in FIG. 2, there is a much higher cooling rate.

FIG. 4 shows the influence of carbon on the above-mentioned characteristic values as a function of the loading temperature with the same manganese contents and the same aluminum contents. It is clear that with increasing carbon content, the strength and yield strength are increased. FIG. 5 shows that the ferrite quantity in the given steel decreases as a function of the carbon content with increasing carbon content.

FIG. 6 and FIG. 8 show the influence of manganese with the same carbon contents and the same aluminum contents. As the manganese content increases, the strength and yield strength also increase whereas, as is clearly shown in FIG. 7, the martensite quantity in the structure increases and the ferrite quantity decreases.

The decisive factor for the invention is that an increasing aluminum content (FIGS. 8, 9) makes it possible to reduce the sensitivity to the loading temperature in the press. It is very clear in FIG. 8 that the tensile strength is less dependent on the loading temperature with a higher aluminum content than it is with 0.5% aluminum. This effect is even clearer in the $R_{p0.2}$ value.

Also, a homogenization can be achieved with regard to the elongation. In the enlarged detail depicting the strength as a function of the loading temperature, it is once again very clear that the increasing aluminum content results in a significant homogenization.

FIG. 9 shows that the increasing aluminum content significantly increases the ferrite quantity. FIG. 10 shows that with fully austenitically annealed carbon/manganese alloys, at high loading temperatures, the strength depends to a massive degree on the cooling rate in the press; with intercritically annealed aluminum-alloyed dual-phase concepts, the dependence of the mechanical properties on both the loading temperature and the cooling rate of the press is significantly reduced, as is clear in the two diagrams in FIG. 10; on the left, a non-aluminum-alloyed steel is used and on the right, an aluminum-alloyed steel dual-phase steel is used.

According to the invention, in order to ensure the presence of a sufficient quantity of ferrite and thus a ferritic matrix in the dual-phase structure, it is sufficient to perform an intercritical annealing in the furnace so that in addition to austenite, ferrite is also present. For the soft partner material, i.e. the dual-phase steel, the Ac3 temperature must be kept high so that the intercritical annealing is even possible. According to the invention, this Ac3 value is increased by means of aluminum.

With the invention, it is thus advantageous that the favorable properties of dual-phase steel can be transferred to a method for press hardening or form hardening, particularly for producing a tailored welded blank.

Specific alloys within and not within the present invention are shown in the Table 1 below.

TABLE 1

| alloy | C, wt. % | Si, wt. % | Mn, wt. % | Al, wt. % | Cr, wt. % | Nb + Ti, wt. % | Ae1, ° C. | Ae3, ° C. | according to the invention |
|---|---|---|---|---|---|---|---|---|---|
| alloy A | 0.06 | 0.2 | 1.5 | 1.0 | 0.5 | 0.03 | 719 | 1000 | yes |
| alloy B | 0.08 | 0.2 | 1.5 | 1.0 | 0.5 | 0.03 | 718 | 981 | yes |
| alloy C | 0.10 | 0.2 | 1.5 | 1.0 | 0.5 | 0.03 | 718 | 968 | yes |
| alloy D | 0.08 | 0.2 | 1.2 | 1.0 | 0.5 | 0.03 | 729 | 1001 | no |
| alloy E | 0.08 | 0.2 | 1.7 | 1.0 | 0.5 | 0.03 | 710 | 975 | no |
| alloy F | 0.08 | 0.2 | 1.5 | 0.5 | 0.5 | 0.03 | 704 | 904 | no |
| alloy G | 0.08 | 0.2 | 1.5 | 1.4 | 0.5 | 0.03 | 730 | 1074 | yes |
| alloy H | 0.30 | 0.3 | 2.2 | <0.05 | <0.05 | <0.05 | 669 | 767 | no |
| alloy I | 0.26 | 0.3 | 1.8 | 0.3 | <0.05 | <0.05 | 658 | 818 | no |
| alloy J | 0.05 | 0.6 | 0.7 | 0.7 | 0.35 | <0.05 | 739 | 1028 | yes |
| alloy K | 0.08 | 0.8 | 1.3 | 0.9 | 0.5 | <0.05 | 734 | 1020 | yes |
| alloy L | 0.10 | 1.3 | 1.8 | 1.3 | 0.7 | <0.05 | 741 | 1087 | yes |
| alloy M | 0.11 | 1.8 | 1.9 | 1.1 | 0.6 | <0.05 | 738 | 1063 | yes |

The invention claimed is:

1. A method for producing a sheet steel component by means of a press hardening or form hardening process, comprising the steps of:

providing a sheet bar having at least one region that includes a hardenable carbon-manganese-boron steel, and at least one other region that includes a dual-phase steel; and forming the sheet bar into the steel sheet component;

wherein the forming of the sheet bar includes the steps of a) cold forming, then heating to an annealing temperature, then quenching the sheet bar in a cooling press, or b) heating the sheet bar to an annealing temperature above an austenization temperature of the hardenable steel and forming and quenching the sheet bar using one or more strokes in a forming and cooling press; and wherein the dual phase steel is softer than the hardenable steel and has an Ac1 temperature and an Ac3 temperature, and the annealing temperature is between the Ac1 temperature and the Ac3 temperature so that only partial austenization of the dual phase steel occurs at the annealing temperature, yielding a matrix that includes ferritic and austenitic components when the dual phase steel enters the cooling press or the forming and cooling press.

2. The method according to claim 1, wherein the annealing temperature is greater than about 800° C. and lower than the Ac3 temperature of the dual phase steel.

3. The method according to claim 1, wherein the heating step is performed in a furnace using a dwell time of between about zero and about 600 seconds.

4. The method according to claim 3, wherein the Ac3 temperature of the dual-phase steel is high enough that a degree of austenitization occurring with the dwell time and the annealing temperature is between 50 volume % and 90 volume %.

5. The method according to claim 1, wherein the quenching in a) or b) is performed at a cooling rate between 5 Kelvin/sec and 500 Kelvin/sec.

6. The method according to claim 1, wherein the sheet bar is formed using a press having a loading temperature between 450 and 850° C.

7. The method according to claim 6, wherein the loading temperature is 700 to 850° C.

8. The method according to claim 6, wherein the loading temperature 400 to 650° C.

9. The method according to claim 5, wherein the cooling rate is between 10 Kelvin/sec and 500 Kelvin/sec.

10. The method according to claim 1, wherein the dual-phase steel contains, in mass %, 0.5 to 1.5% aluminum.

11. The method according to claim 1, wherein the annealing temperature is set so that the dual-phase steel is intercritically annealed at a temperature between its Ac1 temperature and its Ac3 temperature.

12. A welded sheet bar including at least one dual-phase steel material in a first region and a hardenable carbon-manganese-boron steel in a second region, wherein the dual-phase material has the following composition in mass %:

C 0.02-0.12%,
Si 0.01-2.0%,
Mn 0.5-2.0%,
Cr 0.3-1.0%,
Al 0.5-1.5%,
Nb<0.10%,
Ti<0.10%,
Residual and a balance of residual quantities of iron and smelting-related impurities.

13. The welded sheet bar according to claim 12, wherein the dual-phase material contains 0.04-0.10 mass % C.

14. The welded sheet bar according to claim 12, wherein the dual-phase material contains 0.05-1.50 mass % Si.

15. The welded sheet bar according to claim 12, wherein the dual-phase material contains 0.60-1.50 mass % Mn.

16. The welded sheet bar according to claim 12, wherein the dual-phase material contains 0.45-0.80 mass % Cr.

17. The welded sheet bar according to claim 12, wherein the dual-phase material contains 0.40-1.20 mass % Al.

* * * * *